United States Patent [19]

Rothschild

[11] Patent Number: 4,665,790

[45] Date of Patent: May 19, 1987

[54] PITCH IDENTIFICATION DEVICE

[76] Inventor: Stanley Rothschild, 14125 Huckleberry La., Silver Spring, Md. 20906

[21] Appl. No.: 785,741

[22] Filed: Oct. 9, 1985

[51] Int. Cl.[4] ..... B10G 7/02

[52] U.S. Cl. ..... 84/454; 84/DIG. 18; 324/79 R

[58] Field of Search ..... 84/454, DIG. 10, DIG. 18; 324/78 R, 78 D, 78 J, 78 Q

[56] References Cited

U.S. PATENT DOCUMENTS

| | | | |
|---|---|---|---|
| 3,144,802 | 8/1964 | Faber, Jr. et al. | 84/454 |
| 3,788,184 | 1/1974 | Zeiser | 84/454 |
| 3,948,140 | 4/1976 | Ichioka et al. | 84/454 |
| 4,028,985 | 6/1977 | Merritt | 84/454 |
| 4,280,387 | 7/1981 | Moog | 84/454 |
| 4,399,732 | 8/1983 | Rothschild et al. | 84/454 |
| 4,481,857 | 11/1984 | Havener . | |

*Primary Examiner*—L. T. Hix
*Assistant Examiner*—David M. Gray
*Attorney, Agent, or Firm*—Schwartz, Jeffery, Schwaab, Mack, Blumenthal & Evans

[57] ABSTRACT

A transducer receives notes from a musical instrument and converts them into a A.C. signals. The signals are passed to a frequency voltage converter which outputs a D.C. voltage representative of the played note. This voltage is converted to a voltage range indicative of the highest octave of interest and is then divided by a D.C. voltage representing true pitch. This division is then representative of the number of cents between the played note and the true pitch.

11 Claims, 1 Drawing Figure

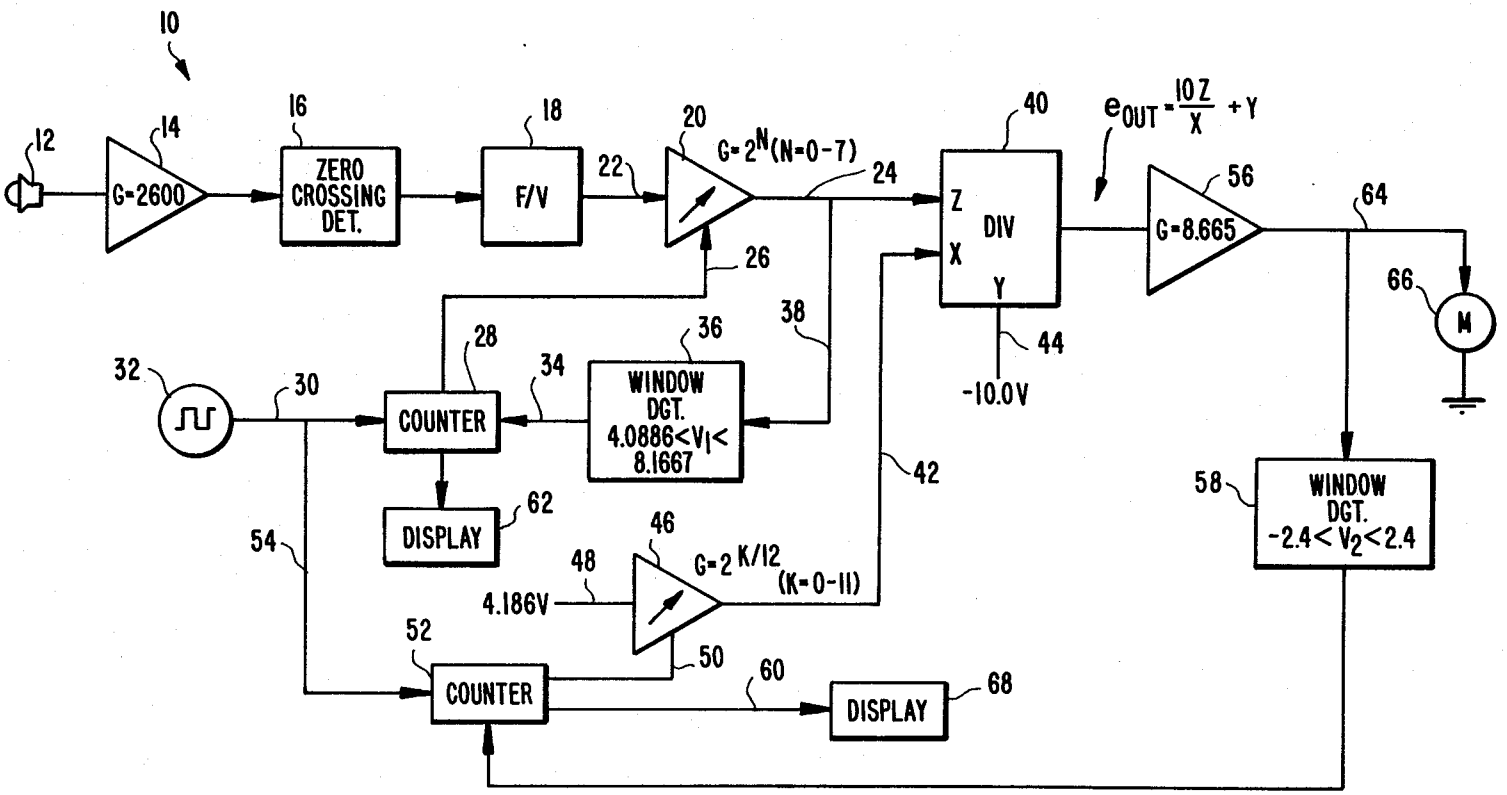
10
12
14
G=2600
16
ZERO CROSSING DET.
18
F/V
20
G=2^N (N=0-7)
22
24
26
28
COUNTER
30
32
34
36
WINDOW DGT. 4.0886<V1<8.1667
38
40
DIV
Z
X
Y
42
44
-10.0V
46
G=2^K/12 (K=0-11)
48
4.186V
50
52
COUNTER
54
56
G=8.665
58
WINDOW DGT. -2.4<V2<2.4
60
62
DISPLAY
64
66
M
68
DISPLAY
e_OUT = 10Z/X + Y

PITCH IDENTIFICATION DEVICE

BACKGROUND OF THE INVENTION

This invention relates to devices for determining the pitch of notes generated by musical instruments.

The tuning procedure for any musical instrument generally requires great skill. Ordinarily, one note is tuned to a standard pitch. The other notes are then tuned relative to the first note and relative to each other by ear. This requires that the tuner be capable of discerning accurately specific frequencies such as "A" which has a fundamental frequency of 440 vibrations per second. Accordingly, several devices have been proposed to assist musicians and other persons involved in tuning instruments in locating exact pitches. U.S. Pat. No. 4,399,732 to Rothschild et al discloses a pitch determination device including a transducer which converts a sound into an electrical signal and a frequency translation circuit for translating the frequency of the electrical signal to a predetermined octave range. A plurality of frequency sensitive circuits are connected to detect the frequencies of individual pitches in the predetermined octave band. This device operates quite effectively but the cost of fabrication is prohibitively high. Accordingly, a need has arisen for a device which is low in cost and can accurately determine the pitch of a succession of individual notes.

U.S. Pat. No. 3,788,184 to Zeiser shows a tuning device in which an input signal is converted to a D.C. voltage. The D.C. voltage is then compared with an attenuator having an output representative of 10 millivolts per Hz.

U.S. Pat. No. 3,144,802 to Faber Jr. et al shows a tuning device in which the frequency of a received signal is determined by counting pulses produced by a frequency generator. A visual display is produced of the exact frequency of the received signal.

U.S. Pat. No. 4,481,857 to Havener shows a system for tuning musical instrument in which the exact frequency of a signal is determined and displayed.

U.S. Pat. No. 4,028,985 to Merritt shows a pitch determination system in which the peaks of a received signal are determined and used to drive a period measuring circuit.

U.S. Pat. No. 4,280,387 to Moog discloses a frequency following circuit in which a plurality of signal peaks are detected and used to produce a voltage proportional to the period between successive peaks.

SUMMARY OF THE INVENTION

One object of the present invention is to provide a pitch identification device which can identify a tone having a frequency which falls within any of eight octaves.

A further object of the present invention is to provide a pitch identification device which can identify pitches in terms familiar to all musicians. That is, the device must identify the pitches in terms of standard musical notation such as A, F#, etc., rather than providing an indication of the frequency of the pitch.

A still further objective of the present invention is to provide a pitch identification device which relieves the musician of the burden of operating a switch to preset the device to a desired pitch.

Yet another object of the present invention is to provide a pitch identification device which can be produced from a relatively limited number of components so as to be inexpensive to manufacture, yet has great versatility.

In accordance with the above and other objects, the present invention is a device for determining the pitch of a sound produced by a musical instrument. The device comprises a transducer for converting the sound to an electrical signal. A frequency to voltage converter is provided for transforming the signal into a voltage which is proportional to the signal frequency. A voltage translation circuit translates the voltage to be equivalent to one representing a corresponding pitch in a predetermined octave band. The translated voltage is then compared to voltages representing known pitches.

The voltage translation circuit may be a gain controllable amplifier whose gain is increased in predetermined increments until the output of the amplifier is within a range indicative of the predetermined octave.

The voltage comparison is made by dividing the output of the gain controllable amplifier by a voltage which is increased in predetermined increments until the output of the divider is within a predetermined range.

BRIEF DESCRIPTION OF THE DRAWING

The above and other objects of the present invention will become more readily apparent as the invention is more fully described in the following detailed description, reference being made to the accompanying drawing which is a block diagram of the pitch identification device of the present invention.

DETAILED DESCRIPTION OF THE PREFERRED EMBODIMENT

The pitch identification device 10 includes a transducer 12 which can be any commercially available microphone. The transducer 12 is connected to an amplifier 14 which can be any standard integrated circuit amplifier such as a Texas Instruments TI074. Amplifier 14 has a very high gain so that its output is a square wave at a frequency equal to that of the signal input to microphone 12. A gain of approximately 2600 is adequate for this purpose. The output of amplifier 14 is passed to a zero crossing detector 16 which generates a square wave at a TTL voltage level equal in frequency to the incoming signal. A National Semiconductor LM319 integrated circuit can be used for this purpose. The square wave output of zero crossing detector 16 is input to a voltage to frequency converter 18 which outputs a D.C. voltage proportional to the frequency of the input signal. A Teledyne-Philbrick 4702 integrated circuit can be used for this purpose. The D.C. output of frequency to voltage converter 18 is passed to a gain controllable amplifier 20 which receives the signal input on line 22 and passes an amplified signal out on line 24. The gain of amplifier 20 is controlled by an input on line 26. The gain controllable amplifier 20 can be a HA2405 circuit manufactured by Harris Corporation.

The gain of amplifier 20 is controlled by the output of a counter 28 which has an input connected through a line 30 from an oscillator 32. Oscillator 32 may be a standard Signetics 555 circuit and counter 28 can be a Texas Instruments SN74193 circuit. Counter 28 also has an enable input connected through a line 34 to a window detector 36. Window detector 36 can be a National Semiconductor LM319 voltage comparator circuit. Window detector 36 receives the output of gain controllable amplifier 20 through line 38. The window detector is set so as to inhibit the counter 28 when the voltage on line 38 is within the range of 4.0886 to 8.1667 volts. This range represents the highest octave of interest, as will be discussed below. When the output voltage of amplifier 20 is below this range, counter 28 is enabled and counts up in response to pulses received from oscillator 32. The output of counter 28 on lines 26 represents a binary number which increases in response to the increasing count in counter 28. This increasing binary signal causes amplifier 20 to have a stepwise increase in its gain $G_1$ which is defined as follows:

$$G_1=2^N \quad (1)$$

where N equals 0 to 7.

N in the above equation represents the number of octaves to which the present invention can respond. The range set in window detector 36 represents the range of voltages which would be produced by signals in the highest of the eight octaves. Accordingly, if a signal is received at microphone 12 in the 8th octave, the output of amplifier 20 is already in the range of window detector 36 so that counter 28 is never enabled. If the signal received at microphone 12 is in the 7th octave, window detector 36 will permit counter 28 to increase by one count thus increasing the output of amplifier 20 to the range of window detector 36 whereupon counter 28 is inhibited. Accordingly, the count in counter 28 will be higher for each successively lower octave with the maximum count being seven representing the lowest octave. Accordingly, it can be seen that the count in counter 28 is representative of the octave occupied by the signal being received by microphone 12. Display 62 then displays the octave of the played tone.

The output of amplifier 20 is presented to analog divider 40 which may be an Analog Devices AD534 integrated circuit. Divider 40 receives the output of amplifier 20 along line 24 at the Z input and receives a second input along a line 42 at the X input. A Y input receives an offset voltage of −10 volts along a line 44. The transfer function of the divider can be represented as follows:

$$e_{out}=(10Z/X)+Y \quad (2)$$

The value of the X input received on line 42 is determined by a second gain controllable amplifier 46 which may also be a Harris Corporation HA2405 device. The signal input of this amplifier is received on line 48 and comprises a D.C. voltage of 4.186 volts. The gain controllable input is received on a line 50 from a second counter 52 which receives the output of oscillator 32 through a line 54. The gain $G_2$ of this amplifier is given as follows:

$$G_2=2^{K/12} \quad (3)$$

where K equals 0 to 11.

The reference input voltage 4.186 volts represents the pitch C. When K=1, the output voltage represents the pitch C♯, K=2 represents the pitch D, etc., until K=11 where the output voltage represents the pitch B.

In terms of musical pitch, a "cent" is the ratio of two tones whose frequencies are the twelvehundredth root of 2, that is $2^{1/1200}$. Thus, 100 cents represents the separation of frequencies which are adjacent to each other on the chromatic scale. A tone that is 50 cents off in frequency would be halfway between two adjacent tones. Thus, a tone which is 50 cents high would have a frequency 1.0293 times higher than the true pitch and a pitch 50 cents low would be 0.9715 times that of the true pitch.

The gain controllable amplifier 46 produces an output, as discussed above, which represents individual notes on the scale. The ratio produced by divider 40 therefore indicates the number of cents between the tone represented by the signal on line 42 and the tone represented by the signal on line 24 if both of these tones are approximately the same pitch. In order to produce the same pitched tone, an amplifier 56 receives the output of divider 40 and amplifies it by a gain of 8.665 which, if the tones on lines 24 and 42 are approximately equal, will produce an output voltage between −2.4 volts and +2.4 volts. This signal is passed to window detector 58 which has an output connected to the enable input of counter 52. If the signal output from amplifier 56 is not within the range of window detector 58, counter 52 is enabled and the pulses from oscillator 32 cause an increase of the count in counter 52. This increase is produced incrementally so that the gain of amplifier 46 is increased incrementally from the pitch C to the pitch C♯, etc. As soon as the pitch signal output from amplifier 46 is close to that output from amplifier 20, the signal from amplifier 56 will be within the window range of detector 58. This will cause an output from detector 58 which inhibits the counter 52.

Counter 52 also has an output on line 60 to a display 68. As will be understood, the count in counter 52 is directly representative of the pitch of the tone on line 24. If the count is 0 the tone is a C., if the count is 1, the tone is C♯, etc. Thus, display 68 can directly display a signal indicative of the pitch of the tone being received at microphone 12 by correlating the count in counter 52 with the appropriate musical note.

As discussed above, the output of divider 40 produces a ratio between the Z input and the X input. This ratio would produce output voltages of 0.293 volt and −0.285 volt when the pitch on line 24 is approximately to that on line 42. The gain of amplifier 56 is set at 8.665 so as to amplify the output voltages from divider 40 to approximately ±2.5 volts which corresponds to approximately ±.05 volts per cent. Thus, it can be seen that the range of window detector 58 is approximately ±50 cents from the exact pitch.

The output of amplifier 56 is also provided through a line 64 to a meter 66 which is calibrated in increments of 0.05 volts. Accordingly, this meter is driven by the output of amplifier 56 so as to indicate the exact number of cents difference between the tone received at microphone 12 and the exact pitch indicated by the signal on line 42. Thus, this meter indicates how sharp or flat the tone is compared to the true pitch.

In operation, one tone at a time is played into microphone 12. This produces a signal having a frequency equal to the played tone. Amplifier 14 amplifies this signal and zero crossing detector 16 converts the signal into a square wave. Frequency to voltage converter 18 outputs a D.C. voltage on line 22 which is indicative of the frequency of the played tone. This D.C. voltage is the input to the gain controllable amplifier 20 which initially outputs the signal on line 24 with no amplification. The gain of amplifier 20 is incrementally increased by counter 28 until the output on line 24 is in the range of window detector 36. The signal on line 24 is then divided in circuit 40 by a signal produced by amplifier 46. The output of amplifier 46 initially represents the pitch C. If the signal on line 24 is not a C., the output of divider 40 is not within the range of window detector 58 and counter 52 is incremented by the output of oscillator 32. Counter 52 is incremented in this manner until the signal on line 42 represents the pitch also represented by the signal on line 24. At this time, the output of divider 40 amplified by amplifier 56 is within the range of detector 58 and counter 52 is inhibited. Display 62 then displays the octave of the played tone, display 68 then displays the pitch of the played tone, and meter 66 represents the number of cents by which the played tone deviates from the actual true tone.

It will be understood that counters 28 and 52 are automatically cleared when no tone is present. Once a tone is played, or changed in pitch, display 62 and meter 66 would then display the octave and sharpness or flatness of the tone as compared to the true pitch.

Changing from one pitch to another will cause the device to search for the new pitch, since the referenced voltage will be outside the voltage window of window detector 36 or 58, causing the counters to increase or decrease the count, as appropriate.

The foregoing explanation is set forth for purposes of illustrating the present invention but is not considered to be limitative thereof. Clearly, numerous additions, substitutions and other changes can be made to the invention without departing from the scope thereof as set forth in the appended claims.

What I claim is:

1. A device for determining the pitch of a sound, comprising:

means for outputting a D.C. voltage representing said pitch of said sound;

means for providing individual D.C. voltages representative, respectively, of true tone pitches;

means for dividing said D.C. voltage representative of said sound pitch by one of said D.C. voltages representative of a true pitch;

means for determining whether the result of said division is within a predetermined range and causing said providing means to provide another of said D.C. voltages representative of another true pitch if said result of said division is outside of said predetermined range; and means for displaying the result of said division.

2. A device as set forth in claim 1 further including means for increasing the voltage of said D.C. voltage representing the pitch of said sound to a voltage range representing a highest octave of interest.

3. A device as set forth in claim 2 wherein said increasing means comprises a gain controllable amplifier receiving said D.C. voltage representative of the pitch of said sound and having an output, a counter for incrementally increasing the gain of said gain controllable amplifier, and means for determining whether the output of said amplifier is within said predetermined range and increasing the count in said counter if said output is not within said predetermined range.

4. A device as set forth in claim 3 wherein said gain controllable amplifier has a gain G defined as follows: $G=2^N$, where $N=0$ to 7.

5. A device as set forth in claim 1 wherein said means for providing D.C. voltage representative of true tone pitches comprises a gain controllable amplifier having an input receiving a D.C. voltage representative of one true pitch, and means for incrementally increasing the gain of said gain controllable amplifier in response to the output of said determining means.

6. A device as set forth in claim 5 wherein said gain controllable amplifier has a gain G defined as follows: $G=2^{K/12}$, where $K=0$ to 11.

7. A device as set forth in claim 3 wherein said count in said counter represents a pitch, and display means for displaying the pitch represented by said count.

8. A method for determining the pitch of a sound comprising:

outputting a D.C. voltage representing said pitch;

producing individual D.C. voltages representative, respectively, of true tone pitches;

dividing said D.C. voltage representative of said sound pitch by one of said D.C. voltages representative of a true pitch;

determining whether the result of said division is within a predetermined range and dividing said D.C. voltage representative of said pitch by another of said D.C. voltages representative of a true pitch if said result of said division is outside of said predetermined range;

repeating said determining step until the result of said division is within said predetermined range; and displaying the result of said division.

9. A method as set forth in claim 8 including the step of increasing the voltage of said D.C. voltage representing the pitch of said sound to a voltage range representing the highest octave of interest.

10. A method as set forth in claim 8 wherein the step of increasing comprises incrementally increasing the count of a counter and incrementally increasing the gain of a gain controllable amplifier in response to the count of said counter.

11. A method as set forth in claim 8 wherein said step of providing individual D.C. voltages comprises providing a D.C. voltage representative of one true tone pitch, and incrementally amplifying said one D.C. voltage to produce said other D.C. voltages representative of true tone pitches.

* * * * *